US008689455B2

(12) United States Patent
Smith et al.

(10) Patent No.: US 8,689,455 B2
(45) Date of Patent: Apr. 8, 2014

(54) SHAFT ALIGNMENT TOOL

(75) Inventors: Danny Ferrel Smith, San Diego, CA (US); Jack Harvey Cabeen, Lakeside, CA (US); James Charles Burgin, San Diego, CA (US); Lars Roesvill Mazanti, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 200 days.

(21) Appl. No.: 13/409,054

(22) Filed: Feb. 29, 2012

(65) Prior Publication Data

US 2013/0219733 A1 Aug. 29, 2013

(51) Int. Cl.
*G01B 5/24* (2006.01)

(52) U.S. Cl.
USPC ..... 33/412; 33/645

(58) Field of Classification Search
USPC ..... 33/412, 529, 613, 645
See application file for complete search history.

(56) References Cited

U.S. PATENT DOCUMENTS 4,214,457 A 7/1980 Wade
4,964,224 A * 10/1990 Jackson ..... 33/645
6,883,224 B2 4/2005 Thomas
7,174,649 B1 * 2/2007 Harris ..... 33/412
7,175,342 B2 * 2/2007 Tanaka et al. ..... 33/412
8,533,965 B2 * 9/2013 Stromberg ..... 33/412
2002/0133960 A1 * 9/2002 Cross ..... 33/412
2002/0138995 A1 * 10/2002 Dameron ..... 33/412
2010/0226770 A1 9/2010 Frick et al.

FOREIGN PATENT DOCUMENTS

RU 2310088 C2 11/2007

* cited by examiner

*Primary Examiner* — G. Bradley Bennett
(74) *Attorney, Agent, or Firm* — Finnegan, Henderson, Farabow, Garrett & Dunner LLP

(57) ABSTRACT

An alignment tool is disclosed for aligning a first shaft assembly and a second shaft assembly to be connected by a coupling device. The alignment tool includes: a housing assembly having a first end and a second end, and a front plate assembly coupled to the first end of the housing assembly. The front plate assembly forms a cavity within the housing, and the front plate assembly has a stationary support housing disposed within the cavity and aligned with the first shaft assembly in the radial direction. The alignment tool also includes a core assembly having a rotatable core shaft disposed within the support housing of the front plate assembly and aligned with the first shaft assembly in the radial direction, the core assembly configured to receive an alignment device for aligning the first shaft assembly and the second shaft assembly in the radial direction.

20 Claims, 6 Drawing Sheets

SHAFT ALIGNMENT TOOL

TECHNICAL FIELD

The present disclosure relates generally to a shaft alignment tool.

BACKGROUND

A turbine engine system may include a high-speed coupling device for connecting an output shaft of a turbine engine and an input shaft of another component, such as a gearbox. To ensure proper operation of the high-speed coupling device during high speed shaft rotation, proper alignment is required between the shafts of the engine and gearbox. Existing alignment techniques involve rotation and handling of shafts themselves, which is cumbersome and dangerous.

For example, U.S. Patent Application Publication No. 2010/0226770 to Frick describes an alignment device for aligning a first turbine engine casing and a second turbine engine casing. The alignment device includes a fixed portion configured to be fixedly attached to the first turbine engine casing and a bridge portion configured to interface with the second turbine engine casing. The alignment device is configured to facilitate movement of the first turbine engine casing relative to the second turbine engine casing.

SUMMARY

In one aspect, an alignment tool is provided for aligning a first shaft assembly and a second shaft assembly to be connected by a coupling device. The alignment tool includes a housing assembly having a first end and a second end, the second end of the housing assembly being configured to couple with the first shaft assembly so that the housing assembly and the first shaft assembly are aligned in a radial direction, and a front plate assembly coupled to the first end of the housing assembly, the front plate assembly forming a cavity within the housing, the front plate assembly having a stationary support housing disposed within the cavity and aligned with the first shaft assembly in the radial direction. The alignment tool further includes a core assembly having a rotatable core shaft disposed within the support housing of the front plate assembly and aligned with the first shaft assembly in the radial direction, the core assembly configured to receive an alignment device for aligning the first shaft assembly and the second shaft assembly in the radial direction.

In another aspect, a method is provided for aligning a first shaft assembly and a second shaft assembly with an alignment tool having a housing assembly, a front plate assembly, and a rotatable core assembly. The method includes mounting the housing assembly to the first shaft assembly so that the housing assembly is aligned with the first shaft assembly in a radial direction, coupling the front plate assembly and the rotatable core assembly to the housing assembly so that the rotatable core assembly is aligned with the first shaft assembly, and mounting an alignment device to the rotatable core assembly for aligning the core assembly with the second shaft assembly in the radial direction.

In still another aspect, a method is provided for aligning a first shaft assembly of a gearbox and a second shaft assembly of an engine with an alignment tool. The method includes mounting a housing assembly to the first shaft assembly, so that the housing assembly is aligned with the first shaft assembly in a radial direction, coupling a rotatable core assembly to the housing assembly so that the rotatable core assembly is aligned with the first shaft assembly, and mounting an alignment device to the rotatable core assembly for aligning the core assembly with the second shaft assembly in the radial direction.

DETAILED DESCRIPTION

Figure 1:
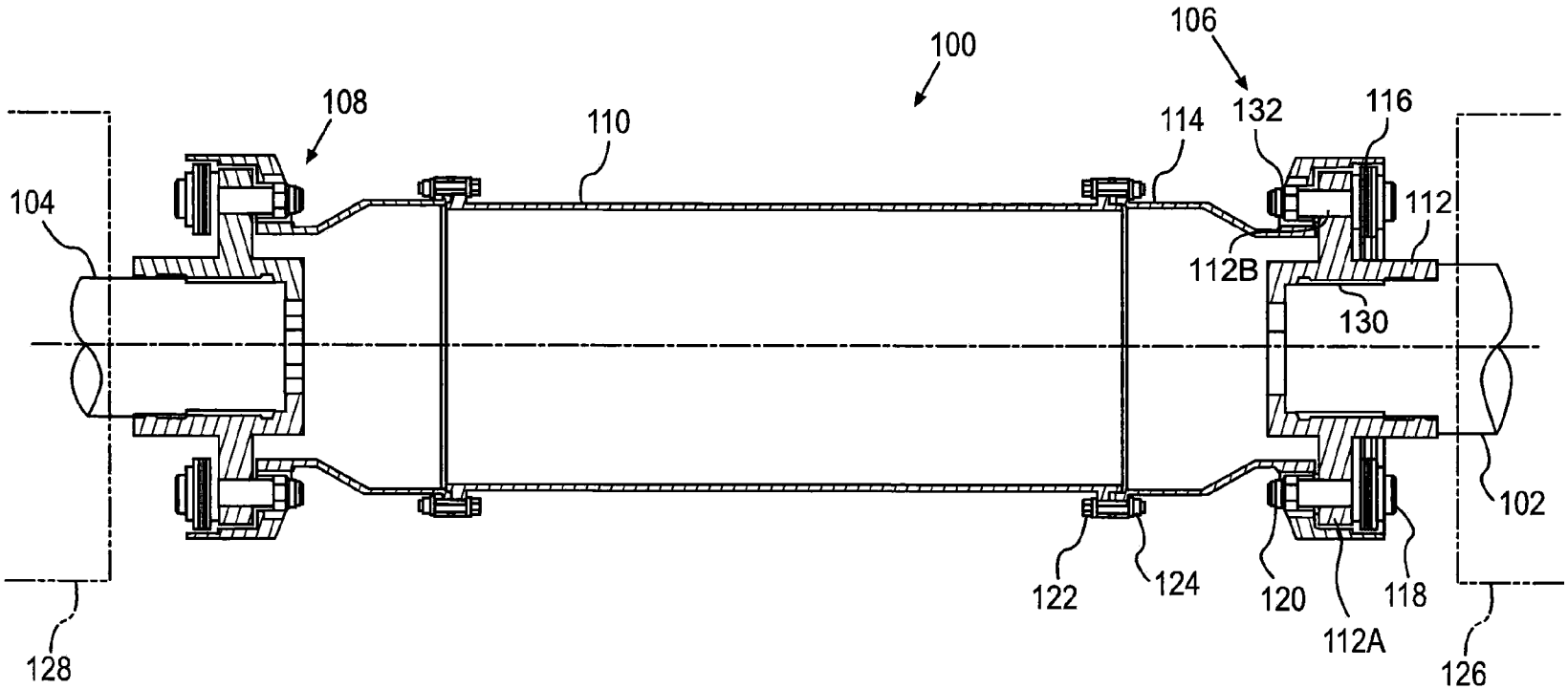
FIG. 1 is a cross-sectional view of an exemplary disclosed high-speed coupling device connecting a turbine engine output shaft and a gearbox input shaft.

FIG. 1 illustrates a high-speed coupling device 100 for connecting an input shaft 102 of a gearbox 126 and an output shaft 104 of a turbine engine 128. Coupling device 100 includes a first end unit 106 coupled to input shaft 102 of gearbox 126, a second end unit 108 coupled to output shaft 104 of turbine engine 128, and a spacer 110 connecting first end unit 106 and second end unit 108. During engine operation, power and torque are transmitted from output shaft 104 of turbine engine 128 to input shaft 102 of gearbox 126 through coupling device 100.

First end unit 106 and second end unit 108 of coupling device 100 are substantially similar. Therefore, only the first end unit 106 will be described in detail herein.

First end unit 106 of coupling device 100 includes a shaft connector 112, a coupling hub 114, and a disc pack 116. Shaft connector 112 is coupled to an end portion of input shaft 102 through a spline coupling 130 and a coupling flange 112A of shaft connector 112. Coupling flange 112A includes a plurality of coupling holes 112B extending therethrough. Coupling hub 114 is coupled to the coupling flange of shaft connector 112 via a disc pack 116. Disc pack 116 is mounted between coupling hub 114 and shaft connector 112 through bolts 118 and nuts 120. Disc pack 116 includes a plurality of disc springs that provide a flexible connection between shaft connector 112 and coupling hub 114. In addition, coupling hub 114 is coupled to spacer 110 through a plurality of bolts 122 and nuts 124.

Before spacer 110 is installed to connect end units 106 and 108, shafts 102 and 104 need to be properly aligned. In one aspect, shafts 102 and 104 need to be aligned in the radial direction (e.g., radial alignment). Radial alignment ensures shafts 102 and 104 are positioned substantially co-axially. The radial alignment may also take into consideration heat expansion of engine components during normal operation. Accordingly, shaft 102 and 104 may be positioned at a small angle with respect to each other. In another aspect, shafts 102 and 104 need to be aligned in the axial direction (e.g., axial alignment). Axial alignment ensures shafts 102 and 104 are positioned at a proper distance from each other in the axial direction so as to provide proper spacing to install spacer 110.

Figure 2:
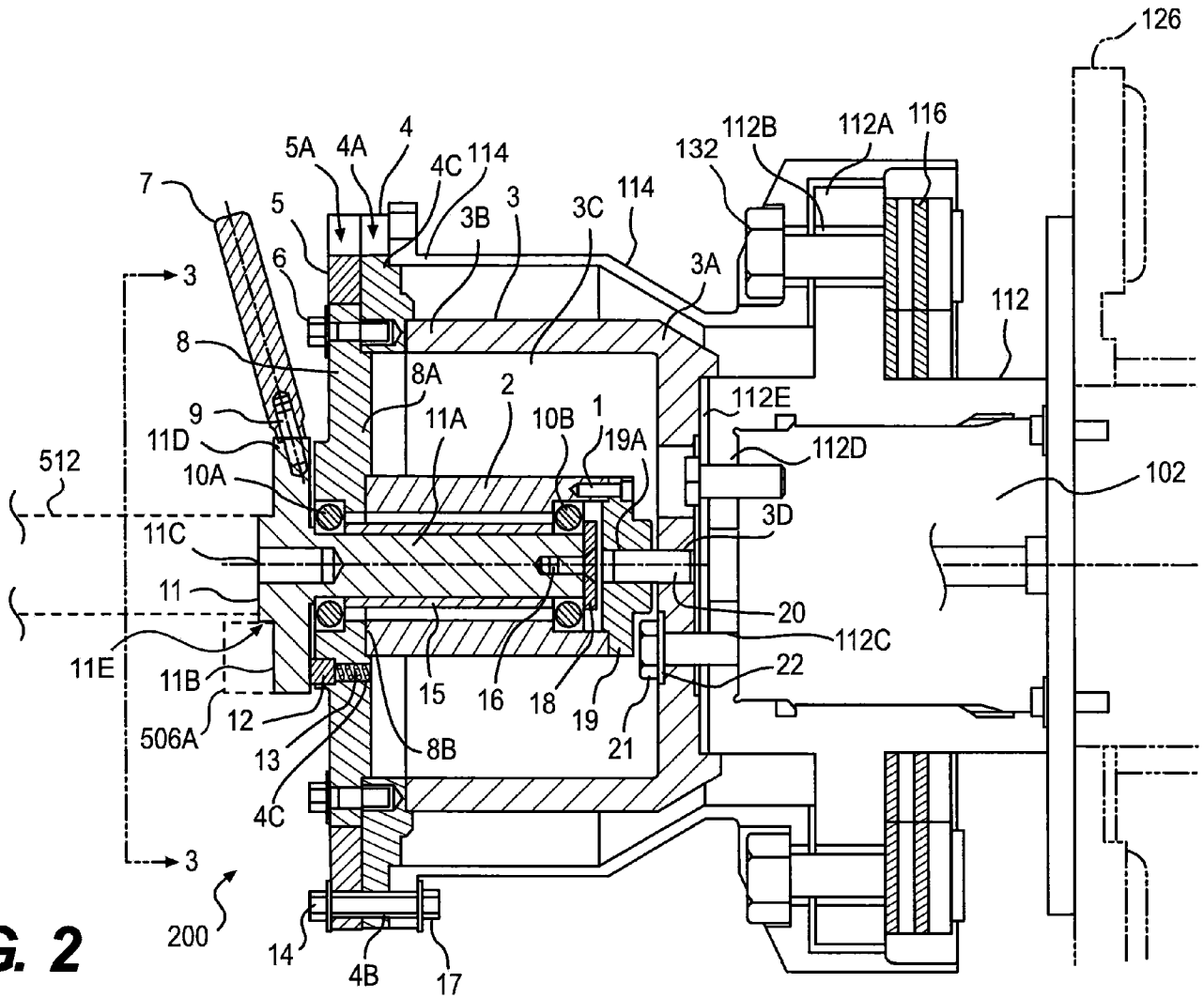
FIG. 2 is a cross-sectional view of an exemplary disclosed alignment tool coupled to an end unit of the high-speed coupling device of FIG. 1.
Figure 3:
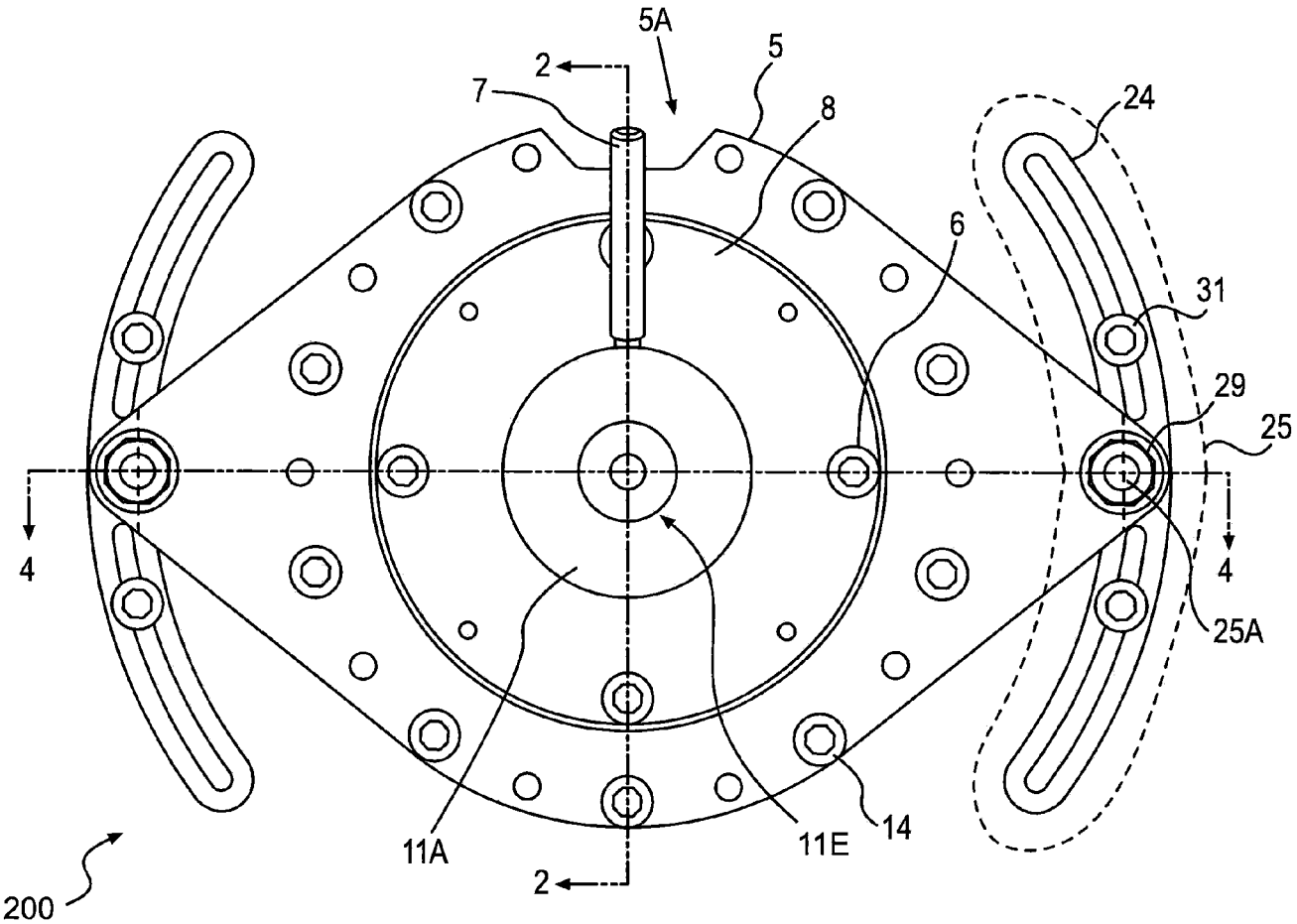
FIG. 3 is an end view of the exemplary disclosed alignment tool of FIG. 2.

According to various embodiments described herein, an alignment tool provides the radial alignment and axial alignment of shafts 102 and 104. FIGS. 2 and 3 illustrates a cross-sectional view and a front view of an exemplary alignment tool 200 when installed on end unit 106 of high speed-coupling device 100 of FIG. 1. Alignment tool 200 includes a housing assembly 3, a front plate assembly 8, and a core assembly 11.

Housing assembly 3 has a bowl-shape body with a closed end 3A and an open end 3B. Closed end 3A of housing assembly 3 has one or more holes for passing through bolts 22 that are received in threaded holes 112C in a top face 112D of shaft connector 112 to mount housing assembly 3 to shaft connector 112. Open end 3B of housing assembly 3 has a flange 4 with a plurality of through holes 4B. Housing assembly 3 is mounted to coupling hub 114 by bolts 14 passing through holes 4B. Flange 4 of housing assembly 3 may be manufactured as an integral single piece of housing assembly 3 or may be manufactured separately and welded to housing assembly 3.

When bolts 22 at closed end 3A of housing assembly 3 are tightened into threaded holes 112C on shaft connector 112, housing assembly 3 moves towards shaft connector 112 in the axial direction. Accordingly, flange 4 of housing assembly 3 abuts against coupling hub 114, resulting in a selective compression force on disc pack 116 through bolt 132, which connects disc pack 116 with coupling hub 114. When bolts 22 are fully tightened, disc pack 116 is compressed into a neutral alignment position or other selected positions. In addition, flange 4 has a step or an outer rim 4C thereon, which is sized and mated with an inner rim of coupling hub 114. The mating between flange 4 of housing assembly 3 and coupling hub 114 provide a radial alignment between housing assembly 3 and coupling hub 114.

Furthermore, closed end 3A of housing assembly 3 is coupled to top face 112D of shaft connector 112 so that top face 112D is received in a recess disposed on an end face of closed end 3A of housing assembly 3. The coupling between closed end 3A of housing assembly 3 and top face 112D of shaft connector 112 provides the radial alignment between housing assembly 3 and shaft connector 112, which in turn aligns housing assembly 3 with input shaft 102 in the radial direction. Accordingly, when bolts 22 are fully tightened, housing assembly 3, shaft connector 112, and shaft input 102 are all substantially aligned in the radial direction. In addition, when bolts 22 are fully tightened and disc pack 116 is compressed to the neutral position or other selected positions, a gap 112E may result between the end face of closed end 3A of housing assembly 3 and the top face of 112D of shaft connector 112.

Front plate assembly 8 has a front cover 8A, a stationary support housing 2 coupled with front cover 8A, and an end cover 19. Housing 2 may have a cylindrical shape and be manufactured separately from front cover 8A and welded thereon. Alternatively, support housing 2 may be formed as an integral part of front cover 8A. End cover 19 is coupled and mounted to an end portion of support housing 2 through one or more bolts 1. Front cover 8A, support housing 2, and end cover 19 are aligned substantially in the radial direction through their coupling.

Front cover 8A is coupled to open end 3B of housing assembly 3 and mounted to flange 4 of housing assembly 3 through a plurality of bolts 6. As a result, front cover 8A and the body of housing assembly 3 form a cavity 3C. Support housing 2 of front plate assembly 8 is disposed within the cavity 3C.

End cover 19 has an alignment hole 19A located substantially at the center thereof and corresponding to an alignment hole 3D at the center of closed end 3A of housing assembly 3. An alignment pin 20 is pressed into and connects alignment hole 19A of end cover 19 with alignment hole 3D of housing assembly 3, so that alignment pin 20 is bridged between end cover 19 and housing assembly 3. The couplings between alignment pin 20 and alignment holes 19A and 3D help provide radial alignment between front plate assembly 8 and housing assembly 3. As a result, front plate assembly 8 is substantially aligned in the radial direction with shaft connector 112 and input shaft 102 through housing assembly 3.

Core assembly 11 includes a core shaft 11A disposed within support housing 2 of front plate assembly 8 and supported by bearings 10A and 10B. Bearings 10A and 10B are disposed at end portions of core shaft 11A. Bearing 10A and 10B may be ball bearings as shown in FIG. 2 or roller or sleeve-type bearings. The bearings 10A and 10B are coupled with support housing 2 to provide relative rotational movement between core shaft 11A and support housing 2. When disposed within support housing 2, core shaft 11A is aligned with input shaft 102 through front plate assembly 8 and housing assembly 3. One skilled in the art will recognized that bearings 10A and 10B are depicted for illustrative purposes and a fewer or greater number of bearings may be used to provide support for core assembly 11.

A spacer 15 is disposed around core shaft 11A between bearings 10A and 10B. An end plate 18 is mounted to an end portion of core shaft 11A through screw 16. When screw 16 is tightened, core shaft 11A is pulled towards end plate 18, thereby pressing bearings 10A and 10B against spacer 15 and securing bearings 10A and 10B to core shaft 11A.

Core shaft 11A has a front disc 11A and an outer rim 11E protruding axially beyond front cover 8A when core shaft 11A is disposed within support housing 2. A threaded hole 11C is disposed substantially at the center of front disc 11A along the axial direction. During an alignment procedure, an alignment device, such as a laser meter, may be mounted on outer rim 11E of front disc 11B through a magnetic coupling. Alternatively, a dial gauge may be mounted onto front disc 11B through threaded hole 11C. Core shaft 11A is rotated to provide alignment measurements between shafts 102 and 104 in the radial direction. This alignment procedure will be described in more detail below.

In order to counter the imbalance due to the weight of the alignment device mounted to front disc 11B and to hold core shaft 11A in a particular position during the alignment procedure, a plunger 12 and a spring 13 are disposed in a hole in front cover 8A. Plunger 12 is pushed by spring 13 against a back end of disc 11B of core assembly 11 so as to apply friction onto front disc 11B. As a result, core shaft 11A may be rotated by a rotational force to a particular direction and stay in that angular position after the rotational force is removed. Plunger 12 may be made from materials including rubber, plastic, metal, composite materials, or other materials known in the art.

According to a further embodiment, a handle 7 may be attached to front disc 11B of core assembly 11 to facilitate the rotation of core shaft 11 A during the alignment procedure. Front disc 11B of core assembly 11 has a threaded hole 11D disposed on the side wall thereof. Handle 7 is secured to front disc 11B of core assembly 11 through a bolt 9 received in threaded hole 11C.

Figure 4:
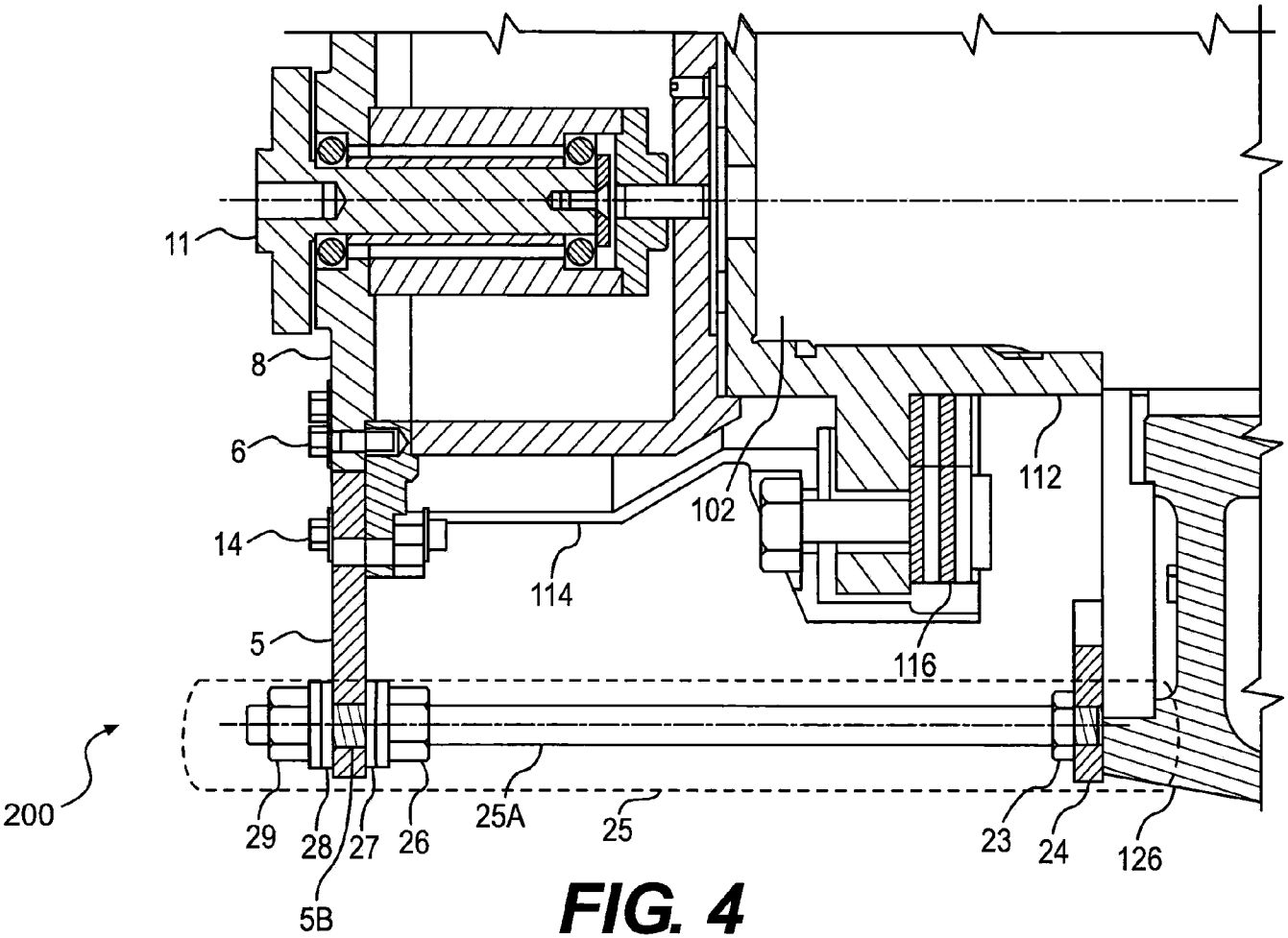
FIG. 4 is another cross-sectional view of the exemplary disclosed alignment tool of FIG. 2.

As shown in FIGS. 3 and 4, alignment tool 200 may include an adjustment mechanism 25 to provide proper alignment and positioning of input shaft 102 in an axial direction before spacer 110 of FIG. 1 is installed.

Specifically, referring to FIG. 4, adjustment mechanism 25 of alignment tool 200 includes an outer plate 5 coupled with front cover 8A and flange 4. Outer plate 5 is mounted to flange 4 of housing assembly 3 through a plurality of bolts 14. The body of outer plate 5 is elongated laterally along a radial direction, as shown in the front view of FIG. 3. Each of the elongated portions of outer plate 5 is connected to a guide rail 24 though a adjustment bolt 25A.

Guide rail 24 is mounted on a housing of gearbox 126 through bolts 31 and has guiding slots disposed thereon. Guide rail 24 can be slid along the guiding slots, thereby adjusting outer plate 5 in a circumferential direction to avoid interference with other components or structures. Guide rails 24 may be made in one piece or separate pieces.

Referring to FIG. 4, each adjustment bolt 25A has one or more screw threads thereupon. The screw threads may be disposed through the entire body of adjustment bolt 25A or on only end portions thereof. One threaded end portion of adjustment bolt 25A is screwed into a threaded hole on guild rail 24 and secured by a nut 23. The other threaded end portion of adjustment bolt 25A protrudes through a hole 5B disposed in the elongated portion of outer plate 5 and secured to outer plate 5 by adjusting nuts 26 and 29 and washers 27 and 28. Outer plate 5 may be moved along the axial direction by tightening or loosening bolts 26 and 29. As a result, shaft 102 of gearbox 126 may be pulled or pushed in the axial direction by moving outer plate 5 away or towards the housing of gearbox 126 during the alignment procedure described below.

Industrial Applicability

Figure 5:
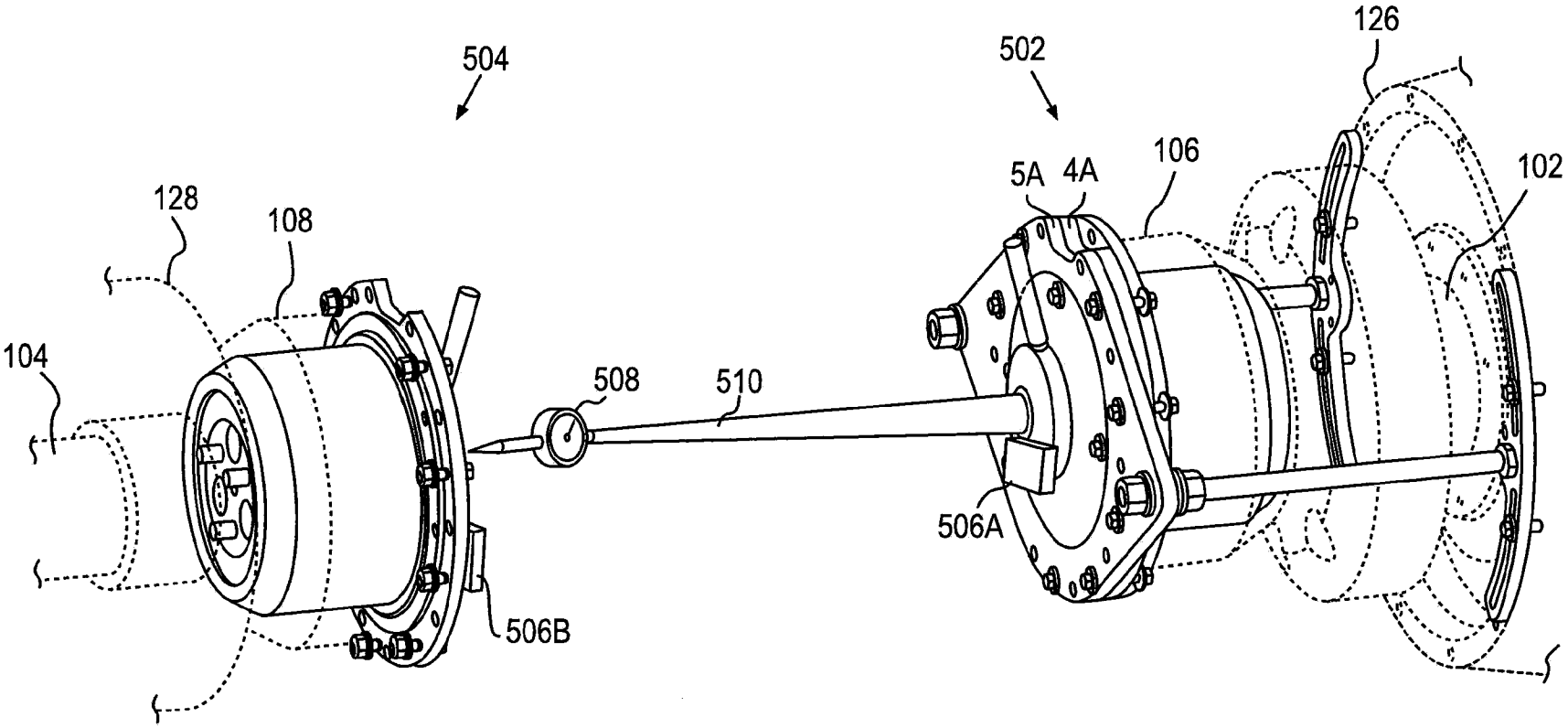
FIG. 5 is a perspective view of exemplary disclosed alignment tools installed on a gearbox side and an engine side, respectively.
Figure 6:
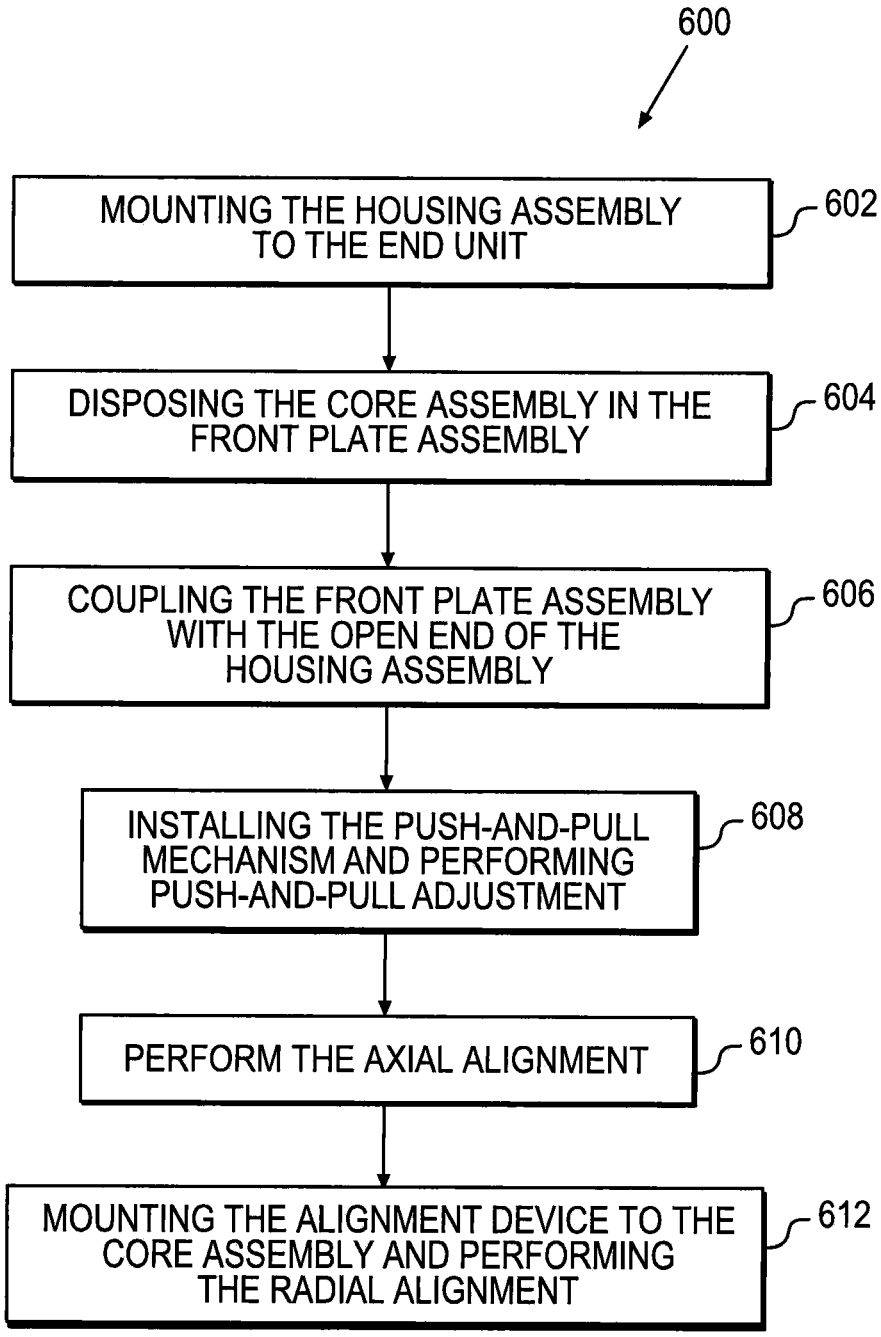
FIG. 6 is a flow diagram of an exemplary disclosed alignment procedure using the alignment tools of FIG. 5.

Alignment tool 100 disclosed above may be used in any mechanical or industrial systems for aligning shafts that are to be coupled axially. For example, alignment tool 100 may be used to align shafts in turbine engine systems, automobiles, air planes, power generators, etc. FIGS. 5 and 6 depicts an alignment procedure using alignment tool 100 for aligning two shafts in a turbine engine system. As described in connection with FIG. 1, when output shaft 104 of turbine engine 128 and input shaft 102 of gearbox 126 are coupled through coupling device 100, radial and axial alignment is required before spacer 110 is installed in order to ensure proper operation.

FIG. 5 illustrates a perspective view of exemplary alignment tools 502 and 504 when they are installed for aligning shafts 102 and 104. Alignment tools 502 and 504 correspond to alignment tool 200 described above in connection with FIGS. 2-4. As further shown in FIG. 5, the adjustment mechanism described above may or may not be needed for the alignment procedure. For brevity, only alignment tool 502 is described herein. One skilled in the art will appreciate that alignment tool 504 operates in a substantially similar fashion.

FIG. 6 illustrates an alignment procedure using alignment tool 502 of FIG. 5. Specifically, at step 602, housing assembly 3 and flange 4 of alignment tool 502 are mounted onto shaft connector 112 via bolts 21. Bolts 21 are tightened so as to selectively compress disc pack 116 to a neutral alignment position or other positions. In addition, housing assembly 3 is adjusted in the circumferential direction such that through holes 4B of flange 4 align with corresponding through holes of coupling hub 114.

At step 604, core assembly 11 is coupled to front plate assembly 8 prior to coupling flange pressed assembly of the housing assembly 3. Specifically, plunger 12 and spring 13 are installed into a hole 4C on front cover 8A. If manufactured separate from front cover 8A, support housing 2 is coupled to front cover 8A through a recess 8B disposed thereon. Core shaft 11A with bearing 10A fitted thereon is disposed within support housing 2 of front plate assembly 8. Front disc 11B of core shaft 11A is pressed against plunger 12 and compresses spring 13. Bearing 10B is fitted onto core shaft 11A within support housing 2. End plate 18 is then installed onto the end portion of core shaft 11A via screw 16. Screw 16 is tightened into core shaft 11A so that core shaft is secured within support housing 2. End cover 19 is then mounted to the end portion of support housing 2 via screw 1. Alignment pin 20 is pushed into the center hole of end cover 19 and protrudes beyond end cover 19.

At step 606, front plate assembly 8, with core assembly 11 installed therein, is mounted to flange 4 of housing assembly 3 via bolts 6. The protruding portion of alignment pin 20 is pushed into center hole 3D of closed end 3A of housing assembly 3.

At step 608, adjustment mechanism 25 is installed onto housing assembly 3. Specifically, guide rails 24 are mounted to the housing of gearbox 126 via bolts 31. The threaded holes on guide rails are aligned, respectively, with the through holes on the elongated portions of outer plate 5. Adjustment bolts 25A are screwed into the threaded holes of guide rails 24. Bolts 23 are tightened to secure adjustment bolts 25A to guide rails 24. Nuts 26 and washers 27 are installed onto adjustment bolts 25A. Outer plate 5 is then mounted to flange 4 by bolts 14. Adjustment bolts 25A pass through the through holes in the elongated portions of outer plate 5. Guide rails 24 are adjusted in the circumferential direction so that the elongated portions of outer plate 5 clears of any interfering objects or structures. In addition, outer plate 5 is secured to flange 4 by bolts 14 through flange 4 of housing assembly 3. Nuts 29 and washers 28 are installed onto pull-and-pull bolts 25A to help to secure outer plate 5.

An adjustment is performed on shaft 102 at step 608. Specifically, the adjustment allows shaft 102 to be properly positioned in the axial direction with respect to the housing of gearbox 126 by adjusting adjustment mechanism 25. During the adjustment, nuts 26 on alignment tool 502 are tightened, while bolts 29 are loosened, along adjustment bolt 25A. As a result, outer plate 5 is pushed by bolts 26 away from gearbox 126, thereby pulling shaft 102 outwards, e.g., in the leftward direction of FIG. 5. Bolts 26 are fully tightened so as to ensure shaft 102 is pulled to the left most position to provide adequate axial redundancy for gear components within gearbox 126. Thereafter, bolts 26 are slightly loosened by one or more turns and bolts 29 are tightened by one or more turns to push shaft 102 slightly back in the rightward direction, thus positioning shaft 102 in a precise manner so as to reintroduce backlash into the gear train, reduce pressure on the gear components, and allow ease of operation during cold start.

During engine operation, output shaft 104 of engine 128 moves towards gearbox 126 (e.g., to the right direction of FIG. 5) due to heat expansion. Without proper axial alignment, the heat expansion of shaft 104 applies undesired axial forces or thrust on input shaft 102 and the gear train within gearbox 126, thereby increasing frictions and wearing of gear and bearing components. By pulling shaft 102 away from the housing of gearbox 126 when the engine is cold, adjustment mechanism 25 provides sufficient axial spacing for the gear components compensating for the movement of output shaft 104 caused by the heat expansion during engine operation.

Alternatively, adjustment mechanism 25 may axially position input shaft 102 of gearbox 126 by pushing shaft 102 towards gearbox 126. Specifically, bolts 29 are tightened and bolts 26 are loosened to pushed shaft 102 inwards to towards to gearbox 126. After bolts 29 are fully tightened so as to pushed shaft 102 to the right most position, they are then loosened by one to two turns to reduce pressure on the gear components.

At step 610, shafts 102 and 104 are aligned in the axial direction. Specifically, alignment tool 200 allows the setting of a precise axial distance between the power turbine engine and the reduction gearbox. As shown in FIGS. 2 and 5, each of flange 4 and outer plate 5 of alignment tool 200 has a cut-out section (i.e., cut-out sections 4A and 5A). When flange 4 and outer plate 5 are installed on coupling hub 114, cut-out sections 4A and 5A thereon expose an area of a front face of coupling hub 114, thereby allowing measurement of the axial distance between coupling hub 114 on input shaft 102 and the corresponding coupling hub on output shaft 104. For example, an adjustable measuring gauge or measuring rod may be used to measure distance between the coupling hubs on input shaft 102 and output shaft 104. Based on the measurement, the axial distance between shafts 102 and 104 may be adjusted to match the axial dimension of spacer 110 of FIG. 1.

At step 612, the radial alignment between shafts 102 and 104 is performed. Such radial alignment can be achieved using conventional methods applied to the disclosed rotatable core assembly 11. Specifically, a radial alignment device, such as a laser meter or a dial gauge, is mounted to front disc 11A of core assembly 11. Core shaft 11A with the alignment device mounted thereon is rotated with the assist of handle 7 so as to provide alignment between shafts 102 and 104 in the radial direction. The radial alignment between shafts 102 and 104 may be performed between alignment tool 502 and the housing of turbine engine 128, between alignment tool 502 and end unit 108, or between alignment tool 502 and output shaft 104 of turbine engine 128.

As shown in FIG. 5, for example, a laser transmitter 506A may be mounted to outer rim 11E of front disc 11A of alignment tool 502 through a magnetic coupling. A laser receiver 506B may be similarly mounted to various components of alignment tool 504 or turbine engine 128. Laser transmitter 506A and receiver 506B may be rotated with respect to each other by rotating front disc 11A, thereby measuring the relative positions of the rational axes of shafts 102 and 104. Based on the measurements provided by laser transmitter 506A and receiver 506B, the positions of shafts 102 and 104 may be adjusted so that they are properly aligned in the radial direction.

Alternatively, as further shown in FIG. 5, a dial gauge 508 may be attached and secured to threaded hole 11B of front disc 11A through an extension arm 510. An end tip of dial gauge 508 may be pressed upon various components of counterpart alignment tool 504, the housing of turbine engine 128, end unit 108 installed on output shaft 104, or output shaft 104 itself. By rotating front disc 11A of alignment tool 502, the end tip of dial gauge 508 traverses upon various portions of the counterpart components, thereby measuring the relative positions between gearbox shaft 102 and turbine shaft 104. Based on the measurements provided by dial gauge 508, the positions of shafts 102 and 104 may be adjusted so that they are properly aligned in the radial direction.

Alignment tool 200 provides attachment points on the rotating features for attaching alignment devices, such as dial gauges or laser alignment devices, as described above. The attachment points allow shop and field personnel to perform alignments using a variety of tools and methods. For example, an alignment can be performed between the housing of turbine engine 128 and alignment tool 200 installed on coupling hub 114, i.e., a tool-housing alignment. Alternatively, an alignment can be performed between the coupling hub of end unit 108 installed on engine shaft 104 and alignment tool 200 installed on coupling hub 114, i.e., a tool-hub alignment. Still alternatively, an alignment can be performed between the alignment tools, such as alignment tools 502 and 504 of FIG. 5, installed on both input shaft 102 and output shaft 104, i.e., a tool-tool alignment. This flexibility also allows for back-to-back redundancy checks of one alignment method against another, thereby troubleshooting complicated issues associated with alignment.

Because core shaft 11A can be easily rotated around substantially the same axis as shaft 102, a radial alignment between shafts 102 and 104 can be performed by aligning core shaft 11A with shaft 104, aligning core shaft 11A with end unit 108 coupled with shaft 104, or aligning core shaft 11A with alignment tool 504 installed on end unit 108. As a result, the alignment procedure does not require rotations of shaft 102 or 104 itself, avoiding cumbersome and dangerous operations. Alignment tool 200 provides rotational features, such as core assembly 11, aligned with input shaft 102 of gearbox 126 or output shaft 104 of turbine engine 128, so that shafts 102 and 104 do not have to be rotated during alignment procedures. This saves time, increases accuracy, and provides overall ergonomic improvement during the alignment procedures. In addition, alignment tool 200 also prevents damages to gearbox 126 and turbine engine 128 due to manipulations of heavy shafts on bearing surfaces that have minimal or no lubrication.

Furthermore, adjustment mechanism 25 of alignment tool 200 provides axial positioning of input shaft 102 of gearbox 126 and the epicyclic gear train bundle mounted thereupon. This axial positioning compensates for the growth of the power turbine over the entire range of thermal operating alignment conditions such that very little axial thrust is transmitted into the turbine engine or the gearbox during normal operation. This axial alignment enhances overall reliability and efficiency of the turbine system. Adjustment mechanism 25 also secures the gearbox shaft in position during alignment procedures, thus saving time and increasing accuracy of the alignment.

The coupling between housing assembly 3 of alignment tool 200 and shaft connector 112 also provides for compression of the spring disc packs 116 of coupling hubs 106 and 108 into the neutral alignment position or other selected positions in-situ. This selective compression allows for an alignment process that removes potential alignment errors due to the flexibility or elasticity of the spring disc packs 116 and provides an alignment process that includes hubs 106 and 108 already installed and thus accounted for in the alignment Alignment tool 200 further allows setting a precise axial distance between the power turbine engine and the reduction gearbox. As discussed above, each of flange 4 and outer plate 5 of alignment tool 200 has a cut-out section (4A and 5A). When flange 4 and outer plate 5 are installed on coupling hub 114, cut-out sections 4A and 5A thereon expose an area of the front face of coupling hub 114, thereby allowing measurement of the axial distance between coupling hub 114 on input shaft 102 and the corresponding coupling hub on output shaft 104, with such a distance compensating for thermal expansion by adjustment mechanism 25 .

When shafts 102 and 104 are aligned according to the process described above, alignment tools 502 and 504 including housing assembly 3 and adjustment mechanism 25 are dismounted from shaft connector 112 and coupling hub 114. Thereafter spacer 110 is mounted and coupled to end units 108 and 106.

Although the shaft alignment tools disclosed herein are discussed in a context of turbine engine system, they can be used to perform shaft alignment procedures in a variety of mechanical or industrial systems, such as automobiles, air planes, ships, power generators, etc.

It will be apparent to those skilled in the art that various modifications and variations can be made to the disclosed alignment tool. Other embodiments will be apparent to those skilled in the art from consideration of the specification and practice of the disclosed alignment tool. It is intended that the specification and examples be considered as exemplary only, with a true scope being indicated by the following claims and their equivalents.

What is claimed is:

1. An alignment tool for aligning a first shaft assembly and a second shaft assembly to be connected by a coupling device comprising:

a housing assembly having a first end and a second end, the second end of the housing assembly being configured to couple with the first shaft assembly so that the housing assembly and the first shaft assembly are aligned in a radial direction;

a front plate assembly coupled to the first end of the housing assembly, the front plate assembly forming a cavity within the housing, the front plate assembly having a stationary support housing disposed within the cavity and aligned with the first shaft assembly in the radial direction; and a core assembly having a rotatable core shaft disposed within the support housing of the front plate assembly and aligned with the first shaft assembly in the radial direction, the core assembly configured to receive an alignment device for aligning the first shaft assembly and the second shaft assembly in the radial direction.

2. The alignment tool of claim 1, wherein the housing assembly further includes a flange disposed at the first end, the flange being coupled to the front plate assembly.

3. The alignment tool of claim 2, wherein the flange includes a step sized to receive a coupling hub associated with the first shaft assembly.

4. The alignment tool of claim 3, wherein the housing assembly is sized to provide a selective axial compression on the coupling hub when the housing is coupled to the first shaft assembly.

5. The alignment tool of claim 4, wherein the second end of the housing has a recess configured to provide radial alignment between the housing assembly and the first shaft assembly.

6. The alignment tool of claim 1, further including an alignment pin coupled between the support housing and the housing assembly.

7. The alignment tool of claim 1, wherein the core assembly includes at least one bearing located between the core shaft and the support housing.

8. The alignment tool of claim 7, wherein the at least one bearing includes a pair of bearings, and the core assembly further includes:

a spacer disposed around the core shaft between the pair of bearings; and an end plate mounted to an end portion of the core shaft and pressing the bearings against the spacer so as to secure the bearings.

9. The alignment tool of claim 1, wherein the core shaft further includes a rotatable front disc located axially beyond the front plate assembly.

10. The alignment tool of claim 9, wherein the front disc is configured to receive the alignment device.

11. The alignment tool of claim 10, wherein a plunger and a spring are disposed within a bore of the front plate assembly;

the spring presses the plunger against the front disc so as to apply a frictional force to the front disc.

12. The alignment tool of claim 1, further including an axial adjustment mechanism for positioning the first shaft assembly in an axial direction.

13. The alignment tool of claim 12, wherein the axial adjustment mechanism includes:

an outer plate coupled to the front plate assembly and mounted to the housing assembly, the outer plate having at least one elongated potion extending along a radial direction;

one or more guide rails configured to be mounted to a housing associated with the first shaft assembly, each of the guide rails includes a sliding slot for adjusting the guide rails in a circumferential direction;

one or more adjustment bolts each having a first threaded end secured to the guide rails, and a second threaded end protruding through the elongated portion of the outer plate; and a plurality of adjusting nuts for adjusting the outer plate in the axial direction.

14. A method for aligning a first shaft assembly and a second shaft assembly with an alignment tool having a housing assembly, a front plate assembly, and a rotatable core assembly, the method comprising:

mounting the housing assembly to the first shaft assembly so that the housing assembly is aligned with the first shaft assembly in a radial direction;

coupling the front plate assembly and the rotatable core assembly to the housing assembly so that the rotatable core assembly is aligned with the first shaft assembly; and mounting an alignment device to the rotatable core assembly for aligning the core assembly with the second shaft assembly in the radial direction.

15. The method of claim 14, wherein mounting the housing assembly to the first shaft assembly includes compressing a disc pack mounted between the first shaft assembly and a coupling hub.

16. The method of claim 14, further including rotating the core assembly to rotate the alignment device.

17. The method of claim 14, further comprising axially adjusting the first shaft assembly by pulling the alignment tool in an axial direction to pull the first shaft assembly in an axial direction.

18. The method of claim 14, wherein the alignment device includes a laser alignment device.

19. A method for aligning a first shaft assembly of a gearbox and a second shaft assembly of an engine with an alignment tool, the method comprising:

mounting a housing assembly to the first shaft assembly, so that the housing assembly is aligned with the first shaft assembly in a radial direction;

coupling a rotatable core assembly to the housing assembly so that the rotatable core assembly is aligned with the first shaft assembly; and mounting an alignment device to the rotatable core assembly for aligning the core assembly with the second shaft assembly in the radial direction.

20. The method of claim 19, wherein mounting the housing assembly to the first shaft assembly includes compressing a disc pack mounted between the first shaft assembly and a coupling hub.

* * * * *

UNITED STATES PATENT AND TRADEMARK OFFICE

CERTIFICATE OF CORRECTION

PATENT NO. : 8,689,455 B2
APPLICATION NO. : 13/409054
DATED : April 8, 2014
INVENTOR(S) : Smith et al.

It is certified that error appears in the above-identified patent and that said Letters Patent is hereby corrected as shown below:

In the Specification

Column 4, line 55, delete “shaft 11 A” and insert -- shaft 11A --.

Column 5, line 4, delete “a adjustment” and insert -- an adjustment --.

Column 5, line 26, delete “Industrial Applicability” and insert -- INDUSTRIAL APPLICABILITY --.

Column 8, line 42, delete “alignment” and insert -- alignment. --.

Column 8, line 53, delete “mechanism 25 .” and insert -- mechanism 25. --.

In the Claims

Column 10, line 8, in Claim 13, delete “potion” and insert -- portion --.

Signed and Sealed this
Fifteenth Day of September, 2015

Michelle K. Lee

Michelle K. Lee
*Director of the United States Patent and Trademark Office*